US006773310B2

(12) United States Patent
Davis

(10) Patent No.: US 6,773,310 B2
(45) Date of Patent: Aug. 10, 2004

(54) BATTERY TERMINAL CONNECTION WITH QUICK-RELEASE LEVER

(76) Inventor: Greg Davis, 990 E. 200 N., Orem, UT (US) 84097

( * ) Notice: Subject to any disclaimer, the term of this patent is extended or adjusted under 35 U.S.C. 154(b) by 75 days.

(21) Appl. No.: 10/172,063

(22) Filed: Jun. 13, 2002

(65) Prior Publication Data

US 2003/0232546 A1 Dec. 18, 2003

(51) Int. Cl.[7] ..... H01R 4/50
(52) U.S. Cl. ..... 439/773; 439/763; 439/764
(58) Field of Search ..... 439/773, 763, 439/764, 772

(56) References Cited

U.S. PATENT DOCUMENTS 3,084,306 A * 4/1963 Cribbs ..... 439/773
4,537,460 A * 8/1985 McCaig ..... 439/773
4,964,819 A 10/1990 Caraballo
5,024,619 A 6/1991 Caraballo
D345,545 S 3/1994 Walters
5,595,510 A 1/1997 Obligar
6,093,064 A * 7/2000 Callen et al. ..... 439/783
6,287,155 B1 9/2001 Yakovich
6,361,381 B1 * 3/2002 Koebbe ..... 439/810
6,364,720 B1 * 4/2002 Liang ..... 439/764
6,494,752 B1 * 12/2002 Liang ..... 439/764

FOREIGN PATENT DOCUMENTS

CA 722313 * 11/1965 ..... 439/773

* cited by examiner

*Primary Examiner*—Gary Paumen
(74) *Attorney, Agent, or Firm*—Steven L. Nichols; Rader, Fishman & Grauer PLLC

(57) ABSTRACT

A battery terminal connector that requires no tools to engage or remove uses a quick-release system in order to increase efficiency. The use of a lever (which makes up an important part of the quick-release system) with a varying radius is used to engage or release the battery terminal connector. The connector is made of an electrically conductive material and connects the battery terminal to the battery cable.

1 Claim, 5 Drawing Sheets

BATTERY TERMINAL CONNECTION WITH QUICK-RELEASE LEVER

FIELD OF THE INVENTION

The present invention relates to the field of battery connectors. More specifically, the present invention relates to a battery connector that can be quickly released by hand without requiring any tools.

BACKGROUND OF THE INVENTION

Batteries are used as a mobile source of power for a wide variety of devices and equipment. Batteries are also used in many vehicles and other types of equipment to ignite a combustion engine. For those devices in which a battery is used, the terminals of the battery are electrically connected to the electrical system in that device equipment or vehicle. Thus, battery terminal connectors are required for connecting the battery to an electrical system in, for example, an automobile, water craft, recreational vehicle, tractor, truck, lawn mower, etc.

Periodically, it is necessary for a battery to be replaced. This may occur because the battery looses the capacity to function properly by being depleted of its charge. In some cases, such as in an automobile, the battery is normally recharged during operation of the device that battery serves. However, even where the battery is rechargeable, it will eventually, through wear and tear, become unable to accept and maintain a charge and will have to be replaced. Additionally, when work is being done on or near the electrical system of, for example, a vehicle, it may be a wise precaution to disconnect the battery from the electrical system to prevent the possibility of being shocked or having an electrical surge damage tools or the equipment being serviced.

Thus, for a variety of reasons, it is periodically necessary to disconnect the battery terminal connectors that connect a battery to an electrical system being served by that battery. Contemporary battery terminal connectors have bolts running trough the two ends of a clamp. A nut at one end of the bolt can be tightened in order for the clamp to be tightened and grip a battery terminal. The action of releasing the nut from the bolt, and thus releasing the clamp from the battery terminal, frequently requires the use of at least one, maybe two, wrenches or similar tools such as pliers.

This is often inconvenient and time consuming for a number of reasons. First, there may not be any of the desired tools readily at hand when it is desired to release a battery terminal connector. Additionally, the battery terminal and connector clamp may be corroded making it difficult to grip the bolt or nut and release the clamp. The nut on the bolt may be stripped and difficult to loosen. Or, the mere location of the battery may obstruct the use of wrenches or other tools to loosen the connector clamp.

SUMMARY OF THE INVENTION

The present invention is a battery terminal connector that provides a means by which it is more effective to service the battery of a vehicle. The quick-release feature of the battery terminal connector allows for quick and easy maintenance of the battery without the need for any tools.

The clamp of the quick-release battery terminal connector consists of the clamp and a lever to engage or release the clamp. The lever of the battery terminal connector is designed so that different radii on the working end of the lever engage or release the clamp. The enlarged portion of the lever is curved and has a hole through which a cross shaft is disposed and is connected to a tension shaft. Through bringing the larger radii between the cross shaft and an arm of the clamp, the clamp is engaged or released. The clamp can then be tightened around the terminal of a battery through using the lever.

The connector is made of a conductive material to allow the electrical potential of the battery to flow through the electrical components of the vehicle or machine. The battery terminal connector connects the battery terminal to the battery cable.

The battery terminal connector can also be used to attach after-market alarm or radio systems. Holes are bored into the connector and those holes are threaded to allow connections for those systems to be integrally attached to the battery terminal connector.

Additional advantages and novel features of the invention will be set forth in the description which follows or may be learned by those skilled in the art through reading these materials or practicing the invention. The advantages of the invention may be achieved through the means recited in the attached claims.

BRIEF DESCRIPTION OF THE DRAWINGS

The accompanying drawings illustrate preferred embodiments of the present invention and are a part of the specification. Together with the following description, the drawings demonstrate and explain the principles of the present invention. The illustrated embodiments are examples of the present invention and do not limit the scope of the invention.

Throughout the drawings, identical reference numbers designate similar, but not necessarily identical, elements.

DETAILED DESCRIPTION OF THE PREFERRED EMBODIMENTS

The present invention provides a battery terminal connector that has a lever for quickly securing the connector to, or releasing the connector from, a battery terminal. A connector according to the present invention replaces previously used connectors which incorporate a bolt and nut to secure the connector to the battery terminal and require at least one, often two, wrenches or other tools for connection to, or removal from, the terminals of the battery. The present invention requires no tools and is more convenient and time effective to operate.

Figure 1:
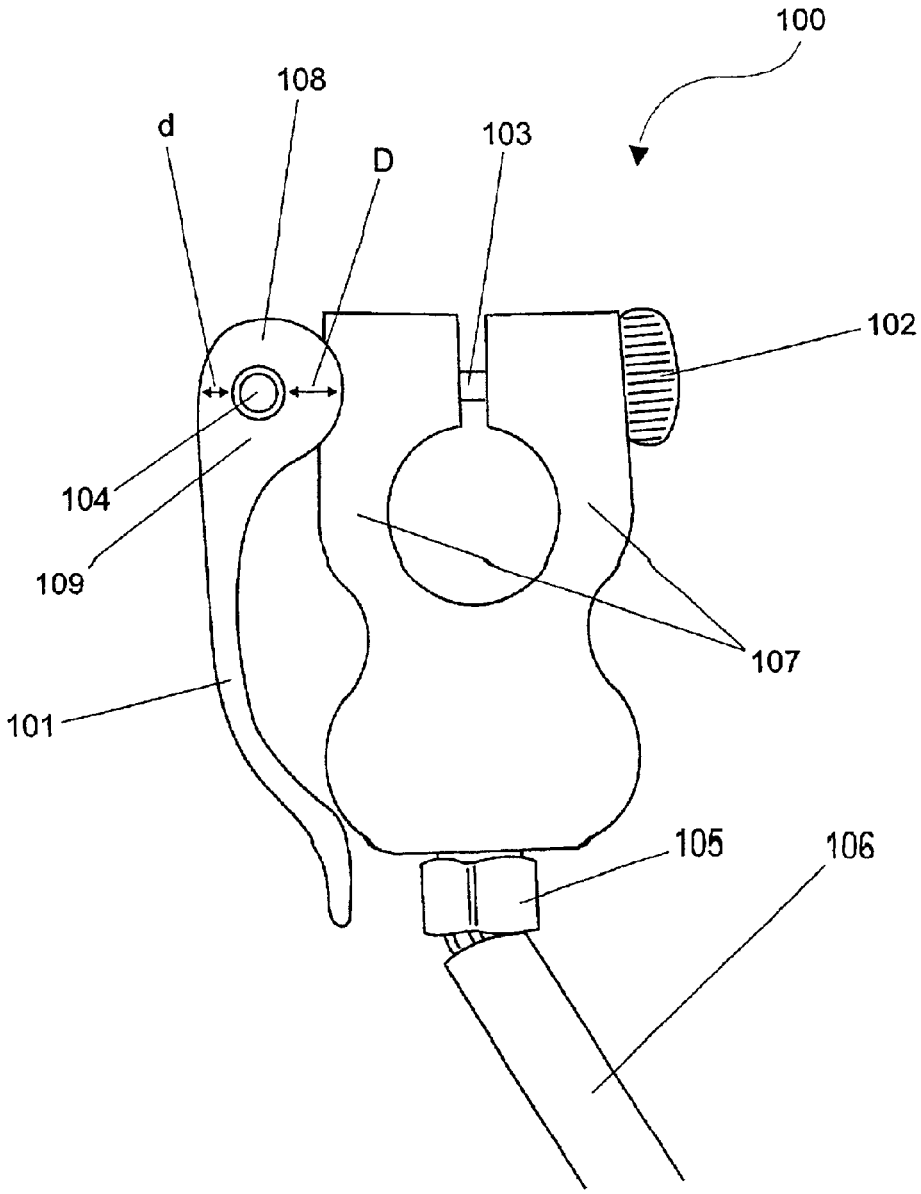
FIG. 1 is an illustration of one embodiment of a battery terminal connector according to the present invention.

Using the supplied drawings, the preferred embodiments of the present invention will now be explained. FIG. 1 illustrates a preferred embodiment of a battery terminal connector (100) according to the present invention. The battery terminal connector (100) is made of a conducting material, preferably metal such as aluminum or steel, so as to allow electrical current to flow easily from the battery, through the connector and into the battery cable (106). The battery cable (106) is, in turn, connected into the electrical system that the battery serves. The present invention is intended for use on either the positive or negative terminal of the battery.

As shown in FIG. 1, the connector (100) includes a lever (101), a tension shaft (103), a nut (102) threaded onto the tension shaft (103), and a cross shaft (104) connected to, or formed integrally with, the tension shaft (103). The nut (102) could alternatively be a head integrally formed on the end of the tension shaft (103) opposite the cross shaft (104). The cross shaft (104) is preferably disposed at right angles to the tension shaft (103). As will be described below, these pieces working together can be used to secure a clamp (107) of the connector (100) around a battery terminal.

The lever (101) preferably has a larger end (109) with a curved edge (108). The enlarged end (109) that has a hole through it receives the cross shaft (104). This hole is communicated with a slot (not shown) through which the tension shaft (103) passes. As indicated above, the tension shaft (103) is connected to or formed integrally with the cross shaft (104). The lever (101) rotates around the cross shaft (104).

The tension shaft (103) may be formed using the straight portion of a bolt with a circular portion at one end in which a hole is formed allowing the cross shaft (104) to run through and connect with the tension shaft (103). In such an embodiment, the tension shaft (103) is connected to the lever (101) by fitting the cross shaft (104) through the hole in the lever and the hole in the tension shaft (103). The tension shaft (103) is placed through the clamp arms (107) of the connector (100) and is held in place by the nut (102). This nut (102) screws onto the tension shaft (103) and holds it in its position in the connector (100).

A key advantage of a connector according to the invention is the quick release aspect of the connector and the ability to clamp and release the connector without the use of tools. The lever (101) allows the connector to be taken off and attached quickly and with ease. The lever (101) is constructed in a way that around the curved surface (108) of the enlarged end (109), the enlarged portion (109) has a radius, measured from the central axis of the cross shaft (104), that gradually varies between a minimum radius (d) and a maximum radius (D). As is seen in FIG. 1, the lever (101) is in a position in which the maximum radius (D) is rotated so as to be between the cross shaft (104) and the clamp arm (107). In this position, the thicker radius (D) creates a pressure between the cross shaft (104) and the arms of the clamp (107). Under this pressure, the arms of the clamp (107) are pulled toward each other allowing the connector (100) to be clamped to a battery terminal. This pressure is sufficient to tightly hold the connector (100) on the battery terminal.

FIG. 1 also shows a cable connector (105) and cable (106) that allows the battery's electrical potential to flow into the electrical system served by the battery when the connector (100) is secured to a battery. The cable connector (105) is attached to the quick release battery terminal connector (100) and the cable (106) is in turn then connected to the cable connector (105).

In a preferred embodiment, the metal components of the connector (100) of the present invention can be anodized, e.g., coated electrolytically with a protective or decorative oxide. Anodizing may be done selectively to some or all of the metal components of the connector (100) and can be used in any embodiment of the present invention.

Figure 2:
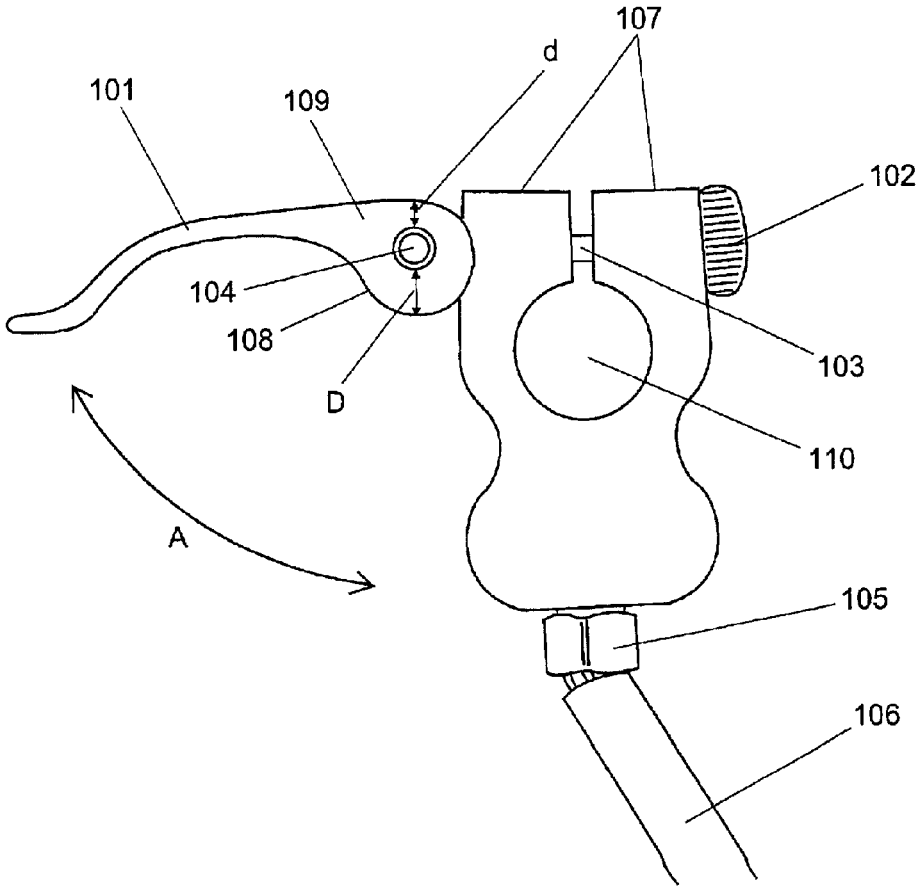
FIG. 2 is an illustration of the battery terminal connector of FIG. 1 in an open position.

FIG. 2 is an illustration of the battery terminal connector of FIG. 1 in an open or released position. As shown in FIG. 2, the lever (101) is rotated as indicated by arrow "A" to an open position. As the lever (101) rotates about the cross shaft (104), the curved surface (108) slides passed the arm of the clamp (107). The thickest radius (D) of the enlarged portion (109) of the lever (101) is moved by the rotation of the lever (101) so as to no longer be positioned between the cross shaft (104) and the left arm of the clamp (107). Rather, a narrower section of the enlarged portion (109) of the lever (101) becomes positioned between the cross shaft (104) and the left arm of the clamp (107). This releases the pressure on the arms of the clamp (107) that is exerted when the thickest radius (D) is forced between the cross shaft (104) and the left arm of the clamp (107). Consequently, the arms of the clamp (107) are no longer urged together and release their hold on the battery terminal, which is held in the opening (110) between the arms of the clamp (107) when the clamp is closed, i.e., in the position shown in FIG. 1.

To reattach the connector (100), the connector (100) is positioned with the battery terminal through the opening (110) in the clamp (107). The lever (101) is then returned to the position illustrated in FIG. 1. This moves the thickest radius (D) back to a position directly between the cross shaft (104) and the left clamp arm (107). As the thickest radius (D) is moved back to a position directly between the cross shaft (104) and the left clamp arm (107), the arms of the clamp (107) are forced back together thereby securing a battery terminal in the opening (110).

The end nut (102) can be tightened or loosened according to the difficulty of moving the lever (101). The tighter the end nut (102) is, the more difficult the lever (101) will be to move to a closed position and the tighter the connector (100) will clamp on the battery terminal. The looser the end nut (102) is, the easier the lever (101) will be to move. Consequently, the looser the connector (100) will be on the battery terminal.

Figure 3:
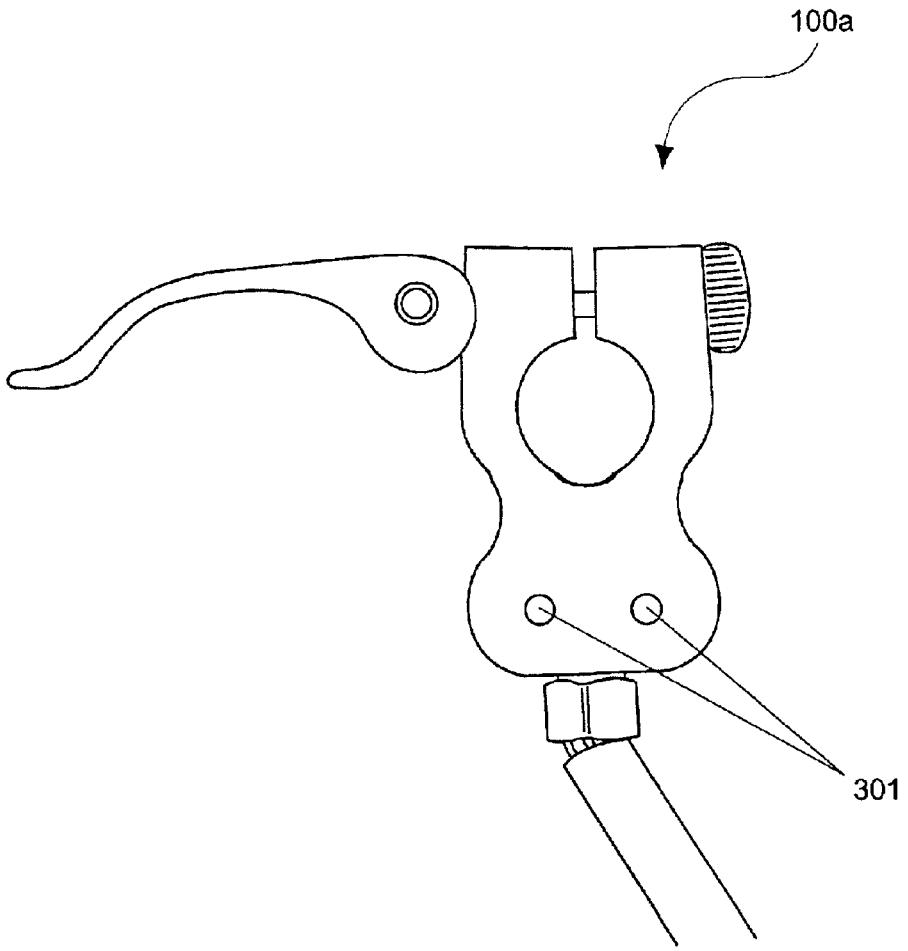
FIG. 3 is an illustration of a battery terminal connector according to another embodiment of the present invention in which bored holes in the connector are provided for use with, for example, after-market equipment such as alarms or stereo equipment.

FIG. 3 illustrates another embodiment of a battery connector according to principles of the present invention. The connector (100*a*) of FIG. 3 includes two small holes (301) in the body of the connector. These holes (301) are preferably threaded and can be provided for the connection of post-manufacturing or after-market systems such as alarm systems and stereo systems that require attachments to the battery. Rather than have these various systems run through the original electric system of the automobile or other battery operated machine, it is often convenient to draw electrical power directly from the terminals of the battery. These holes (301) allow such connections to readily be made. While FIG. 3 illustrates two holes (301) for additional connections, any number of such holes may be added to the connector (100*a*).

Figure 4:
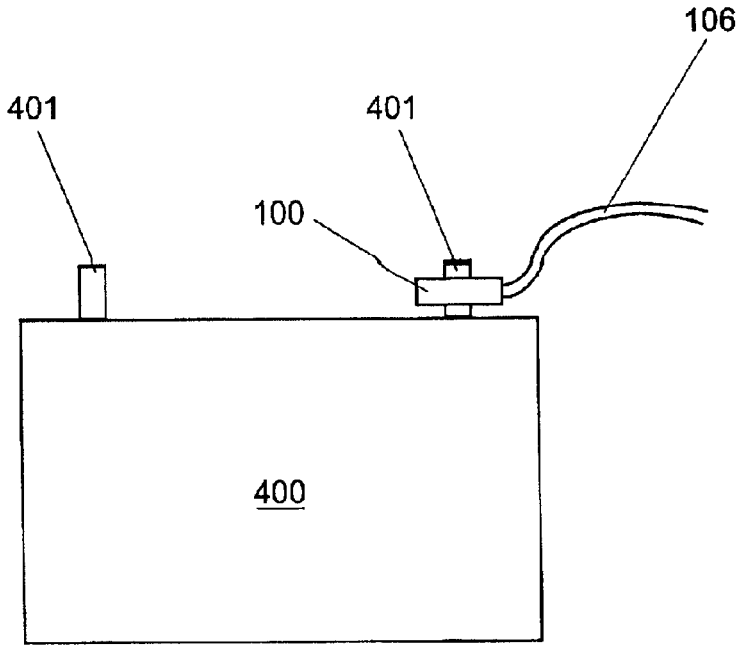
FIG. 4 is an illustration of an embodiment of a battery terminal connector according to the present invention connected to a battery and battery terminal.

FIG. 4 illustrates a battery terminal connector according to the present invention as installed on a battery. As shown in FIG. 4, the connector (100) is secured on a terminal (401) of a battery (400). In FIG. 4, only one connector is shown connected to one of the two battery terminals (401). However, it would be understood by one skilled in the art that to complete a circuit, a connection would have to be made to both battery terminals (401).

A cable (106), as described above, is connected to the connector (100). The cable (106) provides electrical current drawn from the battery terminal connector (100) to the electrical system of the device served by the battery (400).

Figure 5:
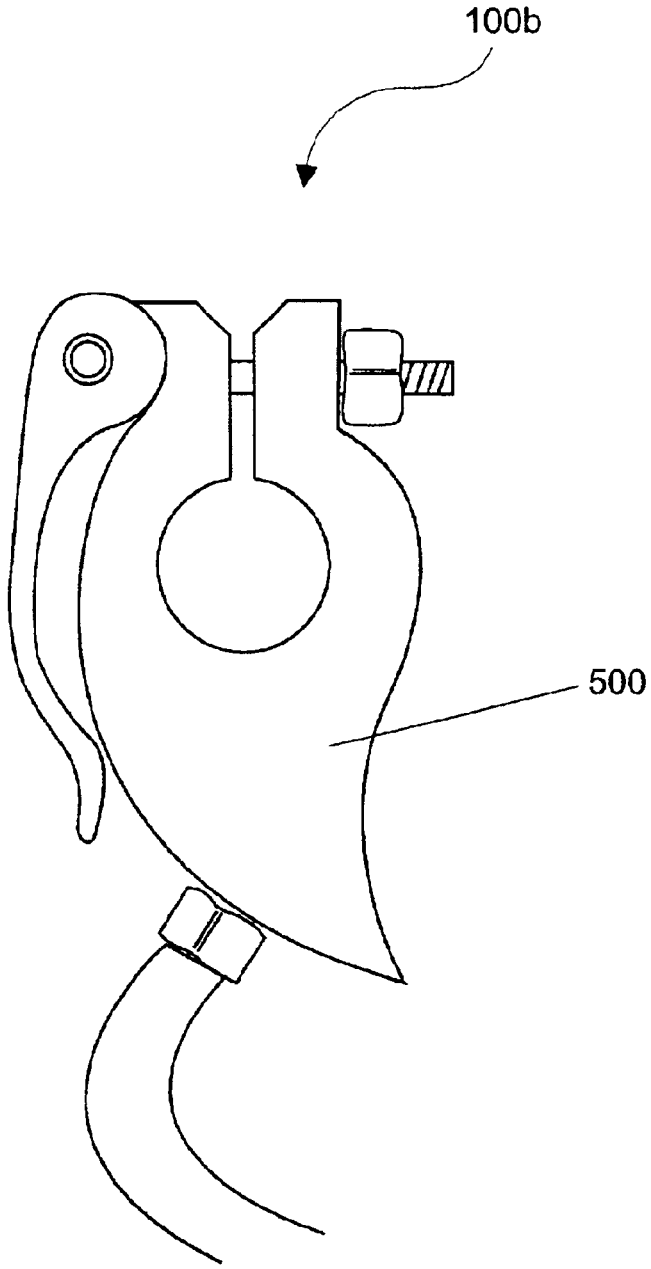
FIG. 5 is an illustration of another embodiment of a battery terminal connector according to the present invention. This connector has a preferred and ornamental design.

FIG. 5 illustrates another embodiment of the quick release battery terminal connector (100*b*) according to the present invention. The elements and operation of the embodiment of FIG. 5 are the same as described above for the embodiment illustrated in FIGS. 1 and 2.

FIG. 5 is an aesthetically pleasing design for a battery terminal connector. As shown in FIG. 5, the body (500) of the connector (100*b*) may be formed with a teardrop or apostrophe-looking shape. The shape may also be described as similar to a chili pepper.

FIG. 5 illustrates a top view of the battery connector (100*b*). The bottom view is substantially the same. The side views do not form any part of the novel, aesthetic design preferred for a battery connector (100*b*). The quick release battery terminal connector (100) is not restricted to the shapes depicted in FIGS. 1, 2, and 3 or 5, but may assume any variety of shapes.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A battery connector comprising:

a clamp for securing said connector to a battery, wherein said claim further comprises;

a body of anodized conductive material having two arms and a hole sized to receive a battery terminal of an automobile battery between said two arms;

a tension shaft running between said two arms of said clamp and through holes in said arms of said clamp, said tension shaft further comprising a stop on an end of said tension shaft, said stop abutting an arm of said clamp, wherein said stop comprises a nut threaded on said tension shaft, said nut comprising knurling thereon to facilitate tightening or loosing of said nut by hand; and a cross shaft connected at an end of said tension shaft;

a lever for applying pressure to engage said clamp, wherein said lever rotates on said cross shaft and comprises a slot for accommodating said tension shaft, said lever further comprising an enlarged portion with a curved edge, said enlarged portion having a hole through which said cross shaft is disposed and a varying radius between said cross shaft and said curved edge such that rotation of said lever about said cross shaft selectively brings a greater or smaller radius of said enlarged portion between said cross shaft and an arm of said clamp to engage or release said clamp;

a cable connector comprising a nut for releasably connecting said battery connector to a power cable; and in addition to said cable connector, one or more connectors in a body of said clamp for electrically connecting one or more additional power lines to said battery connector;

wherein said battery connector is installed or removed by operation of said lever to engage or release said clamp on a terminal of said battery.

* * * * *